United States Patent [19]

Howard

[11] Patent Number: 4,884,071

[45] **Date of Patent: * Nov. 28, 1989**

[54] WELLBORE TOOL WITH HALL EFFECT COUPLING

[75] Inventor: Mig A. Howard, Houston, Tex.

[73] Assignee: Hughes Tool Company, Houston, Tex.

[ * ] Notice: The portion of the term of this patent subsequent to Nov. 29, 2005 has been disclaimed.

[21] Appl. No.: 276,722

[22] Filed: Nov. 28, 1988

Related U.S. Application Data

[63] Continuation-in-part of Ser. No. 1,286, Jan. 8, 1987, Pat. No. 4,788,544.

[51] Int. Cl.[4] ..... G01V 1/00

[52] U.S. Cl. ..... 340/854; 340/870.31; 324/323

[58] Field of Search ..... 340/853, 854, 855, 856, 340/826, 870.11, 870.15, 870.31; 367/81; 324/208, 251, 323, 345, 346; 73/151

[56] References Cited

U.S. PATENT DOCUMENTS

| | | | |
|---|---|---|---|
| 2,370,818 | 3/1945 | Silverman | 324/356 |
| 2,379,800 | 7/1945 | Hare | 175/356 |
| 2,414,719 | 1/1947 | Cloud | 178/44 |
| 3,090,031 | 5/1963 | Lord | 340/18 |
| 3,186,222 | 6/1965 | Martin | 73/151 |
| 3,194,886 | 7/1965 | Mason | 375/88 |
| 3,209,323 | 9/1965 | Grossman, Jr. | 340/856 |
| 3,332,009 | 7/1967 | Searle | 324/208 |
| 3,387,606 | 6/1968 | Crafts et al. | 128/202.27 |
| 3,495,209 | 2/1970 | Engle | 340/850 |
| 3,905,010 | 9/1975 | Fitzpatrick | 340/855 |
| 3,925,694 | 12/1975 | Richter et al. | 310/68 D |
| 4,071,714 | 1/1978 | Satoh | 179/82 |
| 4,215,426 | 7/1980 | Klatt | 367/83 |
| 4,220,381 | 9/1980 | Van der Groat | 439/194 |
| 4,390,975 | 6/1983 | Shawhan | 367/72 |
| 4,403,218 | 9/1983 | Beal et al. | 340/870.31 X |
| 4,468,665 | 8/1984 | Thawley et al. | 340/856 |
| 4,538,248 | 8/1985 | Lenhardt | 324/323 X |
| 4,605,268 | 8/1986 | Meador | 339/16 |
| 4,788,544 | 11/1988 | Howard | 340/853 |

OTHER PUBLICATIONS

T. Bate & C. Martin, "Multisensor Measurements--While-Drilling Tool Improves. . .", Oil & Gas Journal, Mar. 19, 1984, pp. 119-137.

D. Grosso et al., "Report on MWO Experimental Downhole Sensors", Journal of Petroleum Technology, May 1983, pp. 899-907.

A. Kamp, "Downhole Telemetry from the User's Point of View", Journal of Petroleum Technology, Oct. 1983, pp. 1792-1796.

J. C. Archer, "Electric Logging Experiments Develop Attachments", The Oil Weekly, Jul. 15, 1935.

Arpi J. J. & Arpi J. L., "The Substrate Telemetry Problem", Journal of Petroleum Technology, May 1964, pp. 487-493.

Wilton Gravley, "Review of Downhole Measurements. . . Society of Petroleum Engineering Paper #10036", Aug. 1983, pp. 1440-1441.

(List continued on next page.)

*Primary Examiner*—Brian S. Steinberger

*Attorney, Agent, or Firm*—Melvin A. Hunn

[57] ABSTRACT

The present invention is an improved wellbore tool for coupling to a drill string at a threaded junction and adapted for use in a wellbore during drilling. A sensor is disposed in the wellbore tool for sensing a condition and producing a data signal corresponding to the condition. A self-contained power supply is disposed in the wellbore tool and coupled to the sensor for providing power to the sensor as required. The Hall Effect coupling transmitter means is carried by the sensor and for transmitting data from the Hall Effect coupling transmitter means to a Hall Effect coupling receiver carried by the drill string and disposed across the threaded junction from the wellbore tool, wherein data is transmitted across the threaded junction without requiring an electrical connection at the threaded junction.

10 Claims, 6 Drawing Sheets

OTHER PUBLICATIONS

P. Seaton, A. Roberts & L. Schoonover, New MWD--Gamma System, Oil & Gas Journal, Feb. 21, 1983, pp. 80–84.

B. J. Patton et al., Development of Successful Testing, Journal of Petroleum Technology, Oct. 1977.

W. Honeybourne, "Future Measurement-While Drilling Technology", Oil & Gas Journal, Mar. 4, 1985, pp. 71–75.

E. Hearn, "How Operators can Improve Performance of Measurement-While-Drilling Systems", Oil & Gas Journal, Oct. 29, 1984, pp. 80–84.

L. H. Robinson et al., "Exxon Complete Wireline Drilling Data Telemetry System", Oil & Gas Journal, Apr. 14, 1980, pp. 137–148.

E. B. Denison, Downhole Measurements Through Modified Drill Pipe, Journal of Pressure Vessel Technology, May 1977, pp. 374–379.

E. B. Denison, "Shells High-Data-Rate Drilling Telemetry System for First Test", The Oil & Gas Journal, Jun. 3, 1977, pp. 63–66.

E. B. Denison, "High Data Rate Drilling Telemetry System", Journal of Petroleum Technology, Feb. 1979, pp. 155–163.

W. I. McDonald & C. E. Ward, "A Review of Downhole Measurements While Drilling", Sandia National Labs Paper #75-7088, Nov. 1975.

WELLBORE TOOL WITH HALL EFFECT COUPLING

CROSS REFERENCE TO RELATED APPLICATION

This application is a continuation-part-of "Well Bore Data Transmission filed on Jan. 8. 1987, as U.S. Ser. No. 001,286, which has matured into U.S. Pat. No. 4,788,544, on Nov. 29, 1988.

BACKGROUND OF THE INVENTION

1. Field of the Invention

This invention relates to the transmission of data within a wellbore, and is especially useful in obtaining downhole data or measurements while drilling.

2. Description of the Prior Art

In rotary drilling, the rock bit is threaded onto the lower end of a drill string or pipe. The pipe is lowered and rotated, causing the bit to disintegrate geological formations. The bit cuts a bore hole that is larger than the drill pipe, so an annulus is created. Section after section of drill pipe is added to the drill string as new depths are reached.

During drilling, a fluid, often called "mud", is pumped downward through the drill pipe, through the drill bit, and up to the surface through the annulus carrying cuttings from the borehole bottom to the surface.

It is advantageous to detect borehole conditions while drilling. However, much of the desired data must be detected near the bottom of the borehole and is not easily retrieved. An ideal method of data retrieval would not slow down or otherwise hinder ordinary drilling operations, or require excessive personnel or the special involvement of the drilling crew. In addition, data retrieved instantaneously, in "real time", is of greater utility than data retrieved after time delay.

A system for taking measurements while drilling is useful in directional drilling. Directional drilling is the process of using the drill bit to drill a bore hole in a specific direction to achieve some drilling objective. Measurements concerning the drift angle, the azimuth, and tool face orientation all aid in directional drilling. A measurement while drilling system would replace single shot surveys and wireline steering tools, saving time and cutting drilling costs.

Measurement while drilling systems also yield valuable information about the condition of the drill bit, helping determine when to replace a worn bit, thus avoiding the pulling of "green" bits. Torque on bit measurements are useful in this regard. See T. Bates and C. Martin: "Multisensor Measurements-While-Drilling Tool Improves Drilling Economics", *Oil & Gas Journal,* Mar. 19, 1984, p. 119–137; and D. Grosso et al.: "Report on MWD Experimental Downhole Sensors", *Journal of Petroleum Technology*, May 1983, p. 899–907.

Formation evaluation is yet another object of a measurement while drilling system. Gamma ray logs, formation resistivity logs, and formation pressure measurements are helpful in determining the necessity of liners, reducing the risk of blowouts, allowing the safe use of lower mud weights for more rapid drilling, reducing the risks of lost circulation, and reducing the risks of differential sticking. See Bates and Martin article, supra.

Existing measurement while drilling systems are said to improve drilling efficiency, saving in excess of ten percent of the rig time; improve directional control, saving in excess of ten percent of the rig time; allow logging while drilling, saving in excess of five percent of the rig time; and enhance safety, producing indirect benefits. See A. Kamp: "Downhole Telemetry From The User's Point of View", Journal of Petroleum Technology, October 1983, p. 179–296.

The transmission of subsurface data from subsurface sensors to surface monitoring equipment, while drilling operations continue, has been the object of much inventive effort over the past forty years. One of the earliest descriptions of such a system is found in the July 15, 1935 issue of *The Oil Weekly* in an article entitled "Electric Logging Experiments Develop Attachments for Use on Rotary Rigs" by J. C. Karcher. In this article, Karcher described a system for transmitting geologic formation resistance data to the surface, while drilling.

A variety of data transmission systems have been proposed or attempted, but the industry leaders in oil and gas technology continue searching for new and improved systems for data transmission. Such attempts and proposals include the transmission of signals through cables in the drill string, or through cables suspended in the bore hole of the drill string; the transmission of signals by electromagnetic waves through the earth; the transmission of signals by acoustic or seismic waves through the drill pipe, the earth, or the mudstream; the transmission of signals by relay stations in the drill pipe, especially using transformer couplings at the pipe connections; the transmission of signals by way of releasing chemical or radioactive tracers in the mudstream; the storing of signals in a downhole recorder, with periodic or continuous retrieval; and the transmission of data signals over pressure pulses in the mudstream. See generally Arps, J. J. and Arps, J. L.: "The Subsurface Telemetry Problem-A Practical Solution", *Journal of Petroleum Technology,* May 1964, p. 487–93.

Many of these proposed approaches face a multitude of practical problems that foreclose any commercial development. In an article published in August of 1983, "Review of Downhole Measurement-While-Drilling Systems", *Society of Petroleum Engineers Paper Number* 10036, Wilton Gravley reviewed the current state of measurement while drilling technology. In his view, only two approaches are presently commercially viable: telemetry through the drilling fluid by the generation of pressure-wave signals and telemetry through electrical conductors, or "hardwires".

Pressure-wave data signals can be sent through the drilling fluid in two ways: a continuous wave method, or a pulse system.

In a continuous wave telemetry, a continuous pressure wave of fixed frequency is generated by rotating a valve in the mud stream. Data from downhole sensors is encoded on the pressure wave in digital form at the slow rate of 1.5 to 3 binary bits per second. The mud pulse signal loses half its amplitude for every 1,500 to 3,000 feet of depth, depending upon a variety of factors. At the surface, these pulses are detected and decoded. See generally the W. Gravley article, supra, p. 1440.

Data transmission using pulse telemetry operates several times slower than the continuous wave system. In this approach, pressure pulses are generated in the drilling fluid by either restricting the flow with a plunger or by passing small amounts of fluid from the inside of the drill string, through an orifice in the drill string, to the annulus. Pulse telemetry requires about a minute to transmit one information word. See generally the W. Gravley article, supra, p. 1440–1441.

Despite the problems associated with drilling fluid telemetry, it has enjoyed some commercial success and promises to improve drilling economics. It has been used to transmit formation data, such as porosity, formation radioactivity, formation pressure, as well as drilling data such as weight on bit, mud temperature, and torque on bit.

Teleco Oilfield Services, Inc., developed the first commercially available mudpulse telemetry system, primarily to provide directional information, but now offers gamma logging as well. See Gravley article, supra; and "New MWD-Gamma System Finds Many Field Applications", by P. Seaton, A. Roberts, and L. Schoonover, *Oil & Gas Journal,* Feb. 21, 1983 p. 80–84.

A mudpulse transmission system designed by Mobil R. & D. Corporation is described in "Development and Successful Testing of a Continuous-Wave, Logging-While-Drilling Telemetry System", *Journal of Petroleum Technology,* October 1977, by Patton, B. J. et al. This transmission system has been integrated into a complete measurement while drilling system by The Analyst/Schlumberger.

Exploration Logging, Inc., has a mudpulse measurement while drilling service in commercial use that aids in directional drilling, improves drilling efficiency, and enhances safety. Honeybourne, W.: "Future Measurement-While-Drilling Technology Will Focus On Two Levels", *Oil & Gas Journal,* Mar. 4, 1985, p. 71–75. In addition, the Exlog system can be used to measure gamma ray emissions and formation resistivity while drilling occurs. Honeybourne, W.: "Formation MWD Benefits Evaluation and Efficiency", *Oil & Gas Journal,* Feb. 25, 1985, p. 83–92.

The chief problems with drilling fluid telemetry include: (1) a slow data transmission rate; (2) high signal attenuation; (3) difficulty in detecting signals over mud pump noise; (4) the inconvenience of interfacing and harmonizing the data telemetry system with the choice of mud pump, and drill bit; (5) telemetry system interference with rig hydraulics; and (6) maintenance requirements. See generally, Hearn, E.: "How Operators Can Improve Performance of Measurement-While-Drilling Systems", *Oil & Gas Journal* Oct. 29, 1984 , p. 80–84.

The use of electrical conductors in the transmission of subsurface data also presents an array of unique problems. Foremost, is the difficulty of making a reliable electrical connection at each pipe junction.

Exxon Production Research Company developed a hardwire system that avoids the problems associated with making physical electrical connections at threaded pipe junctions. The Exxon telemetry system employs a continuous electrical cable that is suspended in the pipe bore hole.

Such an approach presents still different problems. The chief difficulty with having a continuous conductor within a string of pipe is that the entire conductor must be raised as each new joint of pipe is either added or removed from the drill string, or the conductor itself must be segmented like the joints of pipe in the string.

The Exxon approach is to use a longer, less frequently segmented conductor stored down hole in a spool which will yield more cable, or take up more slack, as the situation requires.

However, the Exxon solution requires that the drilling crew perform several operations to ensure that this system functions properly, and it requires some additional time in making trips. This system is adequately described in L. H. Robinson et al.: "Exxon Completes Wireline Drilling Data Telemetry System", *Oil & Gas Journal,* Apr. 14, 1980, p. 137–148.

Shell Development Company has pursued a telemetry system that employs modified drill pipe, having electrical contact rings in the mating faces of each tool joint. A wire runs through the pipe bore, electrically connecting both ends of each pipe. When the pipe string is "made up" of individual joints of pipe at the surface, the contact rings are automatically mated.

While this system will transmit data at rates three orders of magnitude greater than the mud pulse systems, it is not without its own peculiar problems. If standard metallic-based tool joint compound, or "pipe dope", is used, the circuit will be shorted to ground. A special electrically non-conductive tool joint compound is required to prevent this. Also, since the transmission of the signal across each pipe junction depends upon good physical contact between the contact rings, each mating surface must be cleaned with a high pressure water stream before the special "dope" is applied and the joint is made-up.

The Shell system is well described in Denison, E. B.: "Downhole Measurements Through Modified Drill Pipe", *Journal Of Pressure Vessel Technology,* May 1977, p. 374–379; Denison, E. B.: "Shell's High-Data-Rate Drilling Telemetry System Passes First Test", The Oil & Gas Journal, June 13, 1977, p. 63–66; and Denison, E. B.: "High Data Rate Drilling Telemetry System", *Journal of Petroleum Technology,* February 1979, p. 155–163.

A search of the prior patent art reveals a history of attempts at substituting a transformer or capacitor coupling in each pipe connection in lieu of the hardwire connection. U.S. Pat. No. 2,379,800, Signal Transmission System, by D. G. C. Hare, discloses the use of a transformer coupling at each pipe junction, and was issued in 1945. The principal difficulty with the use of transformers is their high power requirements. U.S. Pat. No. 3,090,031, Signal Transmission System, by A. H. Lord, is addressed to these high power losses, and teaches the placement of an amplifier and a battery in each joint of pipe.

The high power losses at the transformer junction remained a problem, as the life of the battery became a critical consideration. In U.S. Pat. No. 4,215,426, Telemetry and Power Transmission For Enclosed Fluid Systems, by F. Klatt, an acoustic energy conversion unit is employed to convert acoustic energy into electrical power for powering the transformer junction. This approach, however, is not a direct solution to the high power losses at the pipe junction, but rather is an avoidance of the larger problem.

Transformers operate upon Faraday's law of induction. Briefly, Faraday's law states that a time varying magnetic field produces an electromotive force which may establish a current in a suitable closed circuit. Mathematically, Faraday's law is: $emf = d\Phi/dt$ Volts; where emf is the electromotive force in volts, and $d\Phi/dt$ is the time rate of change of the magnetic flux. The negative sign is an indication that the emf is in such a direction as to produce a current whose flux, if added to the original flux, would reduce the magnitude of the emf. This principal is known as Lenz's Law.

An iron core transformer has two sets of windings wrapped about an iron core. The windings are electrically isolated, but magnetically coupled. Current flowing through one set of windings produces a magnetic flux that flows through the iron core and induces an emf in the second windings resulting in the flow of current in the second windings.

The iron core itself can be analyzed as a magnetic circuit, in a manner similar to DC electrical circuit analysis. Some important differences exist however, including the often nonlinear nature of ferromagnetic materials.

Briefly, magnetic materials have a reluctance to the flow of magnetic flux which is analogous to the resistance materials have to the flow of electric currents. Reluctance is a function of the length of a material, L, its cross section, S, and its permeability U. Mathematically, Reluctance$=L \div (U \times S)$, ignoring the nonlinear nature of ferromagnetic materials.

Any air gaps that exist in the transformer's iron core present a great impediment to the flow of magnetic flux. This is so because iron has a permeability that exceeds that of air by a factor of roughly four thousand. Consequently, a great deal of energy is expended in relatively small air gaps in a transformer's iron core. See generally, HAYT: Engineering Electro-Magnetics, McGraw Hill, 1974 Third Edition, p. 305–312.

The transformer couplings revealed in the above-mentioned patents operate as iron core transformers with two air gaps. The air gaps exist because the pipe sections must be severable.

Attempts continue to further refine the transformer coupling, so that it might become practical. In U.S. Pat. No. 4,605,268, Transformer Cable Connector, by R. Meador, the idea of using a transformer coupling is further refined. Here the inventor proposes the use of closely aligned small toroidal coils to transmit data across a pipe junction.

To date none of the past efforts have yet achieved a commercially successful hardwire data transmission system for use in a wellbore.

For data transmission systems to operate to full advantage, it is desirable that wellbore tools, such as drill bits and sensor subassemblies, be produced to cooperate therewith. Wellbore tools could provide significant amounts of useful data. For example, information pertaining to wellbore conditions such as temperature, pressure, and orientation, to formation conditions such as porosity, resistivity, and gamma ray emission, and to tool conditions such as temperature, pressure, torque, wear and probable failure is highly relevant to drilling operations, and not without significant practical and monetary value.

Wellbore tools are often subject to failure while within the wellbore; such failures cause expensive drilling delays. In addition, wellbore tool failures may make further drilling difficult or impossible to accomplish, and often require the specialized skills of oil field service companies to recover or "fish" broken tools from the wellbore.

For example, drill bits are frequently subject to catastrophic mechanical failure while in the wellbore due to loss of lubricant, detached drilling cones, bearing failure, and washout. While such mechanical failures are quite common, they are difficult to predict in the individual case. A variety of drill bit conditions exist which, if known by the drilling crew at the surface, could serve to warn of imminent drill bit failure. Such conditions include lubricant pressure, bit temperature, and the presence of moisture in sealed drill bit cavities.

However, information pertaining to wellbore tool conditions is largely untapped by present drilling technology, due in large part to the difficulty encountered in the transmission of data across the threaded junctions which separate the wellbore tools from drill strings. Of course, the main difficulty encountered in known contactless transmission systems is the significant power requirements.

SUMMARY OF THE INVENTION

The present invention is an improved wellbore tool for coupling to a drill string at a threaded junction and adapted for use in a wellbore during drilling. A sensor is disposed in the wellbore tool for sensing a downhole condition and producing a data signal corresponding to the condition. A self-contained power supply is disposed in the wellbore tool and coupled to the sensor for providing power to the sensor as required. The Hall Effect coupling transmitter means is carried by the sensor and adapted for transmitting data from the Hall Effect coupling transmitter means to a Hall Effect coupling receiver carried by the drill string and disposed across the threaded junction from the wellbore tool, wherein data is transmitted across the threaded junction without requiring an electrical connection at the threaded junction.

The magnetic field is sensed by the adjacent connected tubular member through a Hall Effect sensor. The Hall Effect sensor produces an electrical signal which corresponds to magnetic field strength. This electrical signal may be transmitted via an electrical conductor to a signal conditioning circuit for producing a uniform pulse corresponding to the electrical signal. In one preferred embodiment, this uniform pulse is sent to an electromagnetic field generating means for transmission across the subsequent threaded junction. In this manner, all the tubular members cooperate to transmit the data signals in an efficient manner. Alternately, the improved wellbore tool of the present invention may be interfaced with known wellbore data transmission systems, such as hardwire data transmission systems, or mud pulse data transmission systems which transmit data gathered by the wellbore tool to the surface.

BRIEF DESCRIPTION OF THE DRAWINGS

The novel characteristics believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DESCRIPTION OF PREFERRED EMBODIMENT

The preferred data transmission system uses drill pipe with tubular connectors or tool joints that enable the efficient transmission of data from the bottom of a wellbore to the surface. The configuration of the connectors will be described initially, followed by a description of the overall system, and a description of an improved wellbore tool which may cooperate with either the data transmission system of this invention or other known data transmission systems.

Figure 1:
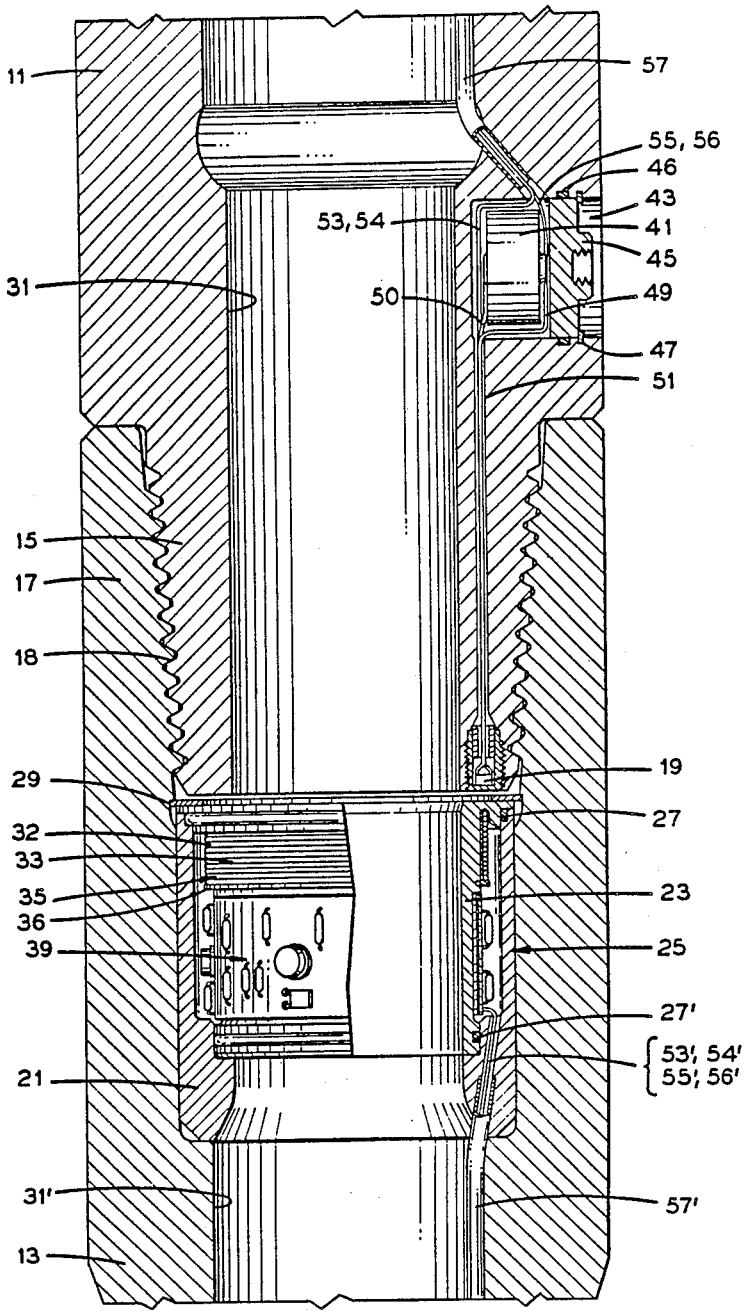
FIG. 1 is a fragmentary longitudinal section of two tubular members connected by a threaded pin and box, exposing the various components that cooperate within the tubular members to transmit data signals across the threaded junction.

In FIG. 1, a longitudinal section of the threaded connection between two tubular members 11, 13 is shown. Pin 15 of tubular member 11 is connected to box 17 of tubular member 13 by threads 18 and is adapted for receiving data signals, while box 17 is adapted for transmitting data signals.

Figure 3:
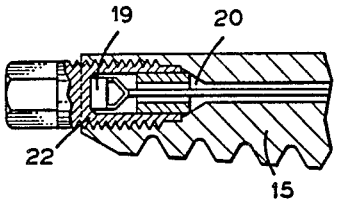
FIG. 3 is a fragmentary longitudinal section of a portion of the pin of a tubular member, demonstrating the preferred method used to place the Hall Effect sensor within the pin.

Hall Effect sensor 19 resides in the nose of pin 15, as is shown in FIG. 3. A cavity 20 is machined into the pin 15, and a threaded sensor holder 22 is screwed into the cavity 20. Thereafter, the protruding portion of the sensor holder 22 is removed by machining.

Returning now to FIG. 1 the box 17 of tubular member 13 is counter bored to receive an outer sleeve 21 into which an inner sleeve 23 is inserted. Inner sleeve 23 is constructed of a nonmagnetic, electrically resistive substance, such as "Monel". The outer sleeve 21 and the inner sleeve 23 are sealed at 27, 27, and secured in the box 17 by snap ring 29 and constitute a signal transmission assembly 25. Outer sleeve 21 and inner sleeve 23 are in a hollow cylindrical shape so that the flow of drilling fluids through the bore 31,31, of tubular members 11, 13 is not impeded.

Protected within the inner sleeve 23, from the harsh drilling environment, is an electromagnet 32, in this instance, a coil 33 wrapped about a ferrite core 35 (obscured from view by coil 33), and signal conditioning circuit 39. The coil 33 and core 35 arrangement is held in place by retaining ring 36.

Power is provided to Hall Effect sensor 19, by a lithium battery 41, which resides in battery compartment 43, and is secured by cap 45 sealed at 46, and snap ring 47. Power flows to Hall Effect sensor 19 over conductors 49, 50 contained in a drilled hole 51. The signal conditioning circuit 39 within tubular member 13 is powered by a battery similar to 41 contained at the pin end (not depicted) of tubular member 13.

Two signal wires 53, 54 reside in cavity 51, and conduct signal from the Hall Effect sensor 19. Wires 53, 54 pass through the cavity 51, around the battery 41, and into a protective metal conduit 57 for transmission to a signal conditioning circuit and coil and core arrangement in the upper end (not shown) of tubular member 11 identical to that found in the box of tubular member 13.

Two power conductors 55, 56 connect the battery 41 and the signal conditioning circuit at the opposite end (not shown) of tubular member 11. Battery 41 is grounded to tubular member 11, which becomes the return conductor for power conductors 55, 56. Thus, a total of four wires are contained in conduit 57.

Conduit 57 is silver brazed to tubular member 11 to protect the wiring from the hostile drilling environment. In addition, conduit 57 serves as an electrical shield for signal wires 53 and 54.

A similar conduit 57' in tubular member 13 contains signal wires 53', 54' and conductors 55', 56' that lead to the circuit board and signal conditioning circuit 39 from a battery (not shown) and Hall Effect sensor (not shown) in the opposite end of tubular member 13.

Figure 2:
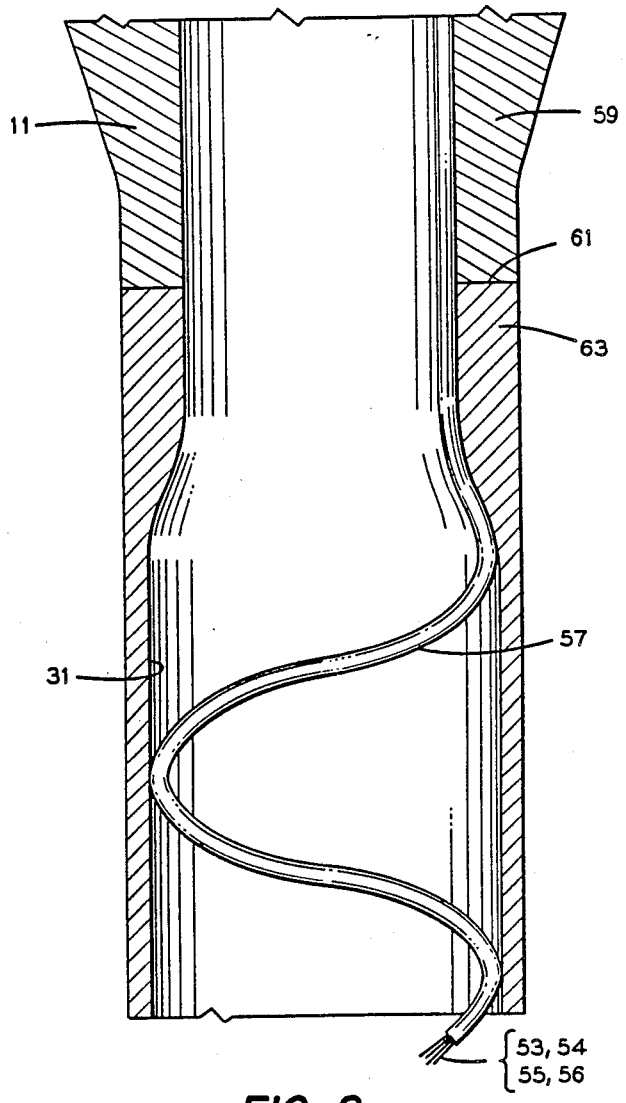
FIG. 2 is a fragmentary longitudinal section portion of a tubular member, revealing conducting means within a protective conduit.

Turning now to FIG. 2, a mid-region of conduit 57 is shown to demonstrate that it adheres to the wall of the bore 31 through the tubular member 11, and will not interfere with the passage of drilling fluid or obstruct wireline tools. In addition, conduit 57 shields signal wires 53, 54 and conductors 55, 56 from the harsh drilling environment. The tubular member 11 consists generally of a tool joint 59 welded at 61 to one end of a drill pipe 63.

Figure 5:
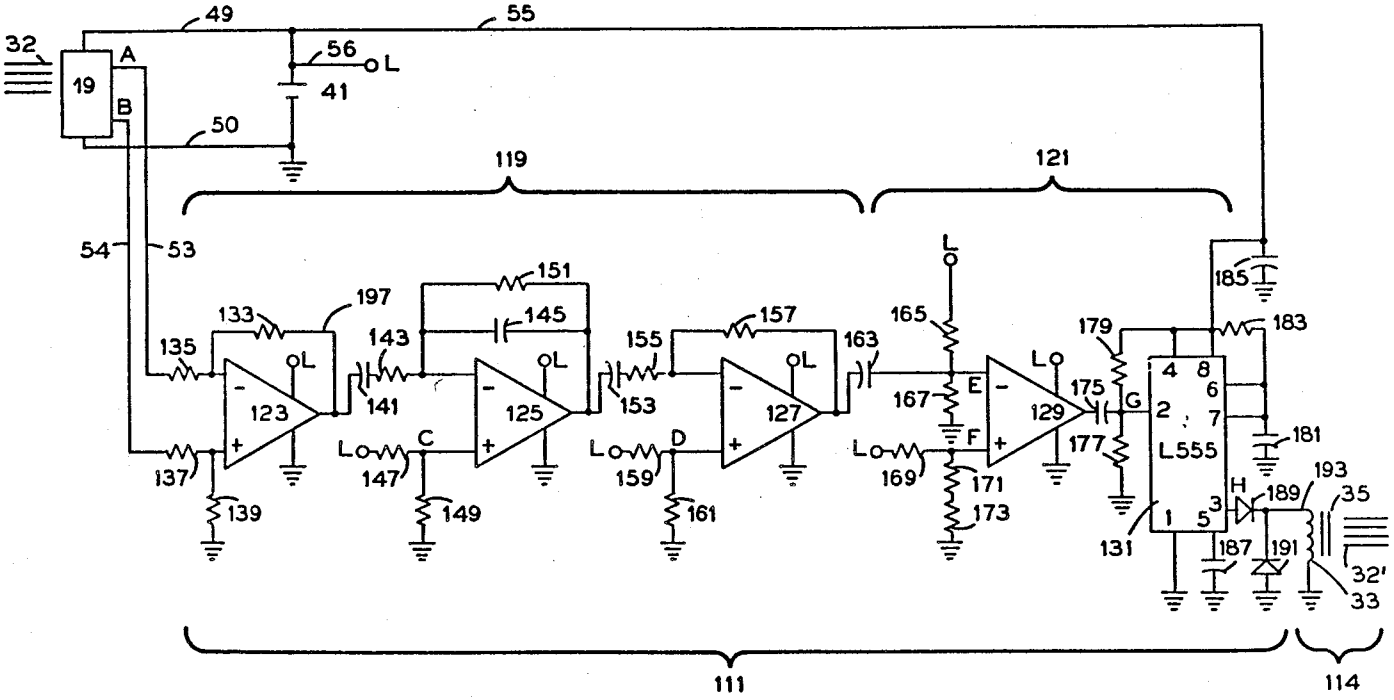
FIG. 5 is a circuit diagram of the signal conditioning means, which is carried within each tubular member.

FIG. 5 is an electrical circuit drawing depicting the preferred signal processing means 111 between Hall Effect sensor 19 and electromagnetic field generating means 114, which in this case is coil 33 and core 35. The signal conditioning means 111 can be subdivided by function into two portions: a signal amplifying means 119 and a pulse generating means 121. Within the signal amplifying means 119, the major components are operational amplifiers 123, 125, and 127. Within the pulse generating means 121, the major components are comparator 129 and multivibrator 131. Various resistors and capacitors are selected to cooperate with these major components to achieve the desired conditioning at each stage.

As shown in FIG. 5, magnetic field 32 exerts a force on Hall Effect sensor 19, and creates a voltage pulse across terminals A and B of Hall Effect sensor 19. Hall Effect sensor 19 has the characteristics of a Hall Effect semiconductor element, which is capable of detecting constant and time-varying magnetic fields. It is distinguishable from sensors such as transformer coils that detect only changes in magnetic flux. Yet another difference is that a coil sensor requires no power to detect time varying fields, while a Hall Effect sensor has power requirements. Hall Effect sensor 19 has a positive input connected to power conductor 49 and a negative input connected to power conductor 50. The power conductors 49, 50 lead to battery 41.

Operational amplifier 123 is connected to the output terminals A, B of Hall Effect sensor 19 through resistors 135, 137. Resistor 135 is connected between the inverting input of operational amplifier 123 and terminal A through signal conductor 53. Resistor 137 is connected between the noninverting input of operational amplifier 123 and terminal B through signal conductor 54. A resistor 133 is connected between the inverting input and the output of operational amplifier 123. A resistor 139 is connected between the noninverting input of operational amplifier 123 and ground. Operational amplifier 123 is powered through a terminal L which is connected to power conductor 56. Power conductor 56 is connected to the positive terminal of battery 41.

Operational amplifier 123 operates as a differential amplifier. At this stage, the voltage pulse is amplified about threefold. Resistance values for gain resistors 133 and 135 are chosen to set this gain. The resistance values for resistors 137 and 139 are selected to complement the gain resistors 137 and 139.

Operational amplifier 123 is connected to operational amplifier 125 through a capacitor 141 and resistor 143.

The amplified voltage is passed through capacitor 141, which blocks any DC component, and obstructs the passage of low frequency components of the signal. Resistor 143 is connected to the inverting input of operational amplifier 125.

A capacitor 145 is connected between the inverting input and the output of operational amplifier 125. The noninverting input or node C of operational amplifier 125 is connected to a resistor 147. Resistor 147 is connected to the terminal L, which leads through conductor 56 to battery 41. A resistor 149 is connected to the noninverting input of operational amplifier 125 and to ground. A resistor 151 is connected in parallel with capacitor 145.

At operational amplifier 125, the signal is further amplified by about twenty fold. Resistor values for resistors 143, 151 are selected to set this gain. Capacitor 145 is provided to reduce the gain of high frequency components of the signal that are above the desired operating frequencies. Resistors 147 and 149 are selected to bias node C at about one-half the battery 41 voltage.

Operational amplifier 125 is connected to operational amplifier 127 through a capacitor 153 and a resistor 155. Resistor 155 leads to the inverting input of operational amplifier 127. A resistor 157 is connected between the inverting input and the output of operational amplifier 127. The noninverting input or node D of operational amplifier 127 is connected through a resistor 159 to the terminal L. Terminal L leads to battery 41 through conductor 56. A resistor 161 is connected between the noninverting input of operational amplifier 127 and ground.

The signal from operational amplifier 125 passes through capacitor 153 which eliminates the DC component and further inhibits the passage of the lower frequency components of the signal. Operational amplifier 127 inverts the signal and provides an amplification of approximately thirty fold, which is set by the selection of resistors 155 and 157. The resistors 159 and 161 are selected to provide a DC level at node D.

Operational amplifier 127 is connected to comparator 129 through a capacitor 163 to eliminate the DC component. The capacitor 163 is connected to the inverting input of comparator 129. Comparator 129 is part of the pulse generating means 121 and is an operational amplifier operated as a comparator. A resistor 165 is connected to the inverting input of comparator 129 and to terminal L. Terminal L leads through conductor 56 to battery 41. A resistor 167 is connected between the inverting input of comparator 129 and ground. The noninverting input of comparator 129 is connected to terminal L through resistor 169. The noninverting input is also connected to ground through series resistors 171,173.

Comparator 129 compares the voltage at the inverting input node E to the voltage at the noninverting input node F. Resistors 165 and 167 bias node E of comparator 129 to one-half of the battery 41 voltage. Resistors 169, 171, and 173 cooperate together to hold node F at a voltage value above one-half the battery 41 voltage.

When no signal is provided from the output of operational amplifier 127, the voltage at node E is less than the voltage at node F, and the output of comparator 129 is in its ordinary high state (i.e., at supply voltage). The difference in voltage between nodes E and nodes F should be sufficient to prevent noise voltage levels from activating the comparator 129. However, when a signal arrives at node E, the total voltage at node E will exceed the voltage at node F. When this happens, the output of comparator 129 goes low and remains low for as long as a signal is present at node E.

Comparator 129 is connected to multivibrator 131 through capacitor 175. Capacitor 175 is connected to pin 2 of multivibrator 131. Multivibrator 131 is preferably an L555 monostable multivibrator.

A resistor 177 is connected between pin 2 of multivibrator 131 and ground. A resistor 179 is connected between pin 4 and pin 2. A capacitor 181 is connected between ground and pins 6, 7. Capacitor 181 is also connected through a resistor 183 to pin 8. Power is supplied through power conductor 55 to pins 4,8. Conductor 55 leads to the battery 41 as does conductor 56, but is a separate wire from conductor 56. The choice of resistors 177 and 179 serve to bias input pin 2 or node G at a voltage value above one-third of the battery 41.

A capacitor 185 is connected to ground and to conductor 55. Capacitor 185 is an energy storage capacitor which helps to provide power to multivibrator 131 when an output pulse is generated. A capacitor 187 is connected between pin 5 and ground. Pin 1 is grounded. Pins 6, 7 are connected to each other. Pins 4, 8 are also connected to each other. The output pin 3 is connected to a diode 189 and to coil 33 through a conductor 193. A diode 191 is connected between ground and the cathode of diode 189.

The capacitor 175 and resistors 177, 179 provide an RC time constant so that the square pulses at the output of comparator 129 are transformed into spiked trigger pulses. The trigger pulses from comparator 129 are fed into the input pin 2 of multivibrator 131. Thus, multivibrator 131 is sensitive to the "low" outputs of comparator 129. Capacitor 181 and resistor 183 are selected to set the pulse width of the output pulse at output pin 3 or node H. In this embodiment, a pulse width of 100 microseconds is provided.

The multivibrator 131 is sensitive to "low" pulses from the output of comparator 129, but provides a high pulse, close to the value of the battery 41 voltage, as an output. Diodes 189 and 191 are provided to inhibit any ringing, or oscillation encountered when the pulses are sent through conductor 193 to the coil 33. More specifically, diode 191 absorbs the energy generated by the collapse of the magnetic field. At coil 33, a magnetic field 32, is generated for transmission of the data signal across the subsequent junction between tubular members.

Figure 4:
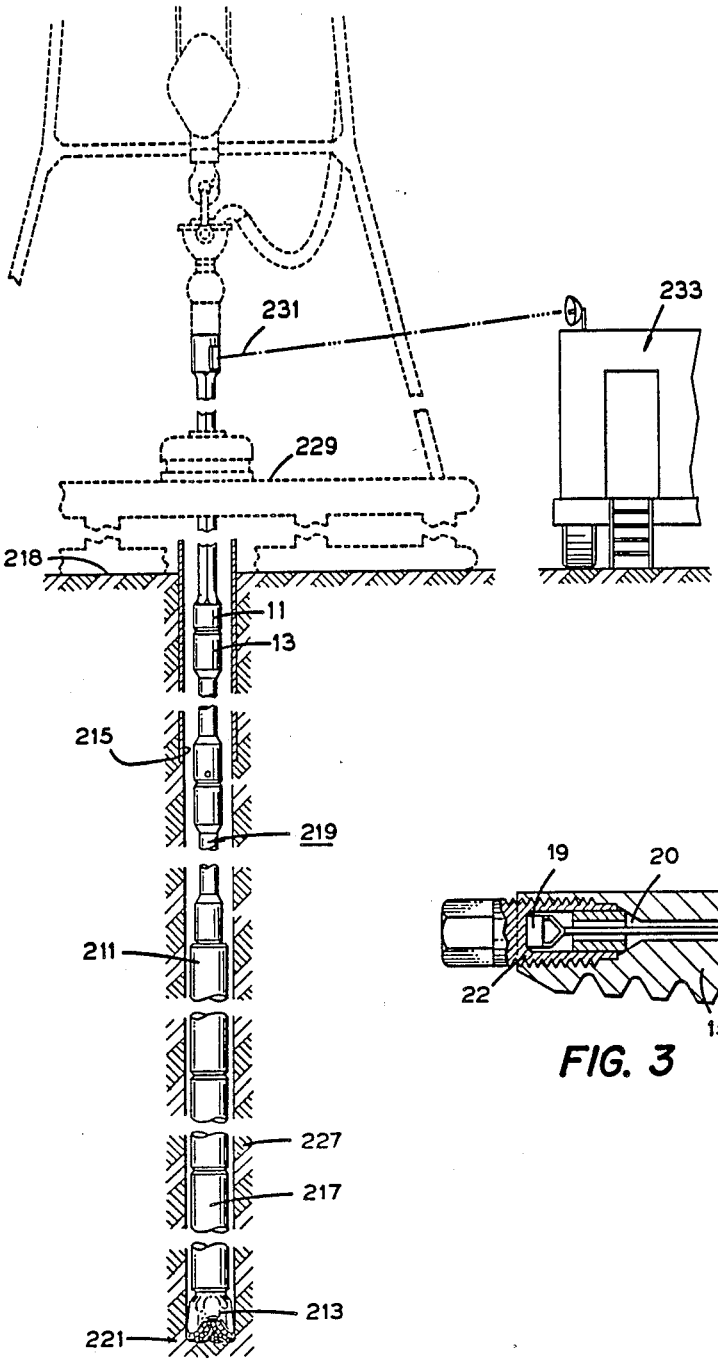
FIG. 4 is a view of a drilling rig with a drill string composed of tubular members adapted for the transmission of data signals from downhole sensors to surface monitoring equipment.

As illustrated in FIG. 4, the previously described apparatus is adapted for data transmission in a wellbore. A drill string 211 supports a drill bit 213 within a wellbore 215 and includes a tubular member 217 having a sensor package (not shown) to detect downhole conditions. The tubular members 11, 13 shown in FIG. 1 just below the surface 218 are typical for each set of connectors, containing the mechanical and electronic apparatus of FIGS. 1 and 5.

The upper end of tubular member and sensor package 217 is preferably adapted with the same components as tubular member 13, including a coil 33 to generate a magnetic field. The lower end of connector 27 has a Hall Effect sensor, like sensor 19 in the lower end of tubular member 11 in FIG. 1.

Each tubular member 219 in the drill string 211 has one end adapted for receiving data signals and the other end adapted for transmitting data signals.

The tubular members cooperate to transmit data signals up the borehole 215. In this illustration, data is being sensed from the drill bit 213, and from the formation 227, and is being transmitted up the drill string 211 to the drilling rig 229, where it is transmitted by suitable means such as radio waves 231 to surface monitoring and recording equipment 233. Any suitable commercially available radio transmission system may be employed. One type of system that may be used is a PMD "Wireless Link", receiver model R102 and transmitter model T201A.

In operation of the electrical circuitry shown in FIG. 5, DC power from battery 41 is supplied to the Hall Effect sensor 19, operational amplifiers 123, 125, 127, comparator 129, and multivibrator 131. Referring also to FIG. 4, data signals from sensor package 217 cause an electromagnetic field 32 to be generated at each threaded connection of the drill string 211.

In each tubular member, the electromagnetic field 32 causes an output voltage pulse on terminals A, B of Hall Effect sensor 19. The voltage pulse is amplified by the operational amplifiers 123, 125 and 127. The output of comparator 129 will go low on receipt of the pulse, providing a sharp negative trigger pulse. The multivibrator 131 will provide a 100 millisecond pulse on receipt of the trigger pulse from comparator 129. The output of multivibrator 131 passes through coil 33 to generate an electromagnetic field 32' for transmission to the next tubular member.

This invention has many advantages over existing hardwire telemetry systems. A continuous stream of data signal pulses, containing information from a large array of downhole sensors can be transmitted to the surface in real time. Such transmission does not require physical contact at the pipe joints, nor does it involve the suspension of any cable downhole. Ordinary drilling operations are not impeded significantly; no special pipe dope is required, and special involvement of the drilling crew is minimized Moreover, the high power losses associated with a transformer coupling at each threaded junction are avoided. Each tubular member has a battery for powering the Hall Effect sensor, and the signal conditioning means; but such battery can operate in excess of a thousand hours due to the overall low power requirements of this invention.

The present invention employs efficient electromagnetic phenomena to transmit data signals across the junction of threaded tubular members. The preferred embodiment employs the Hall Effect, which was discovered in 1879 by Dr. Edwin Hall. Briefly, the Hall Effect is observed when a current carrying conductor is placed in a magnetic field. The component of the magnetic field that is perpendicular to the current exerts a Lorentz force on the current. This force disturbs the current distribution, resulting in a potential difference across the current path. This potential difference is referred to as the Hall voltage.

The basic equation describing the interaction of the magnetic field and the current, resulting in the Hall voltage is:

$$V_H=(R_H/t) * I_c * B * \text{SIN } X,$$

where:

$I_c$ is the current flowing through the Hall sensor;

B * SIN X is the component of the magnetic field that is perpendicular to the current path;

$R_H$ is the Hall coefficient; and t is the thickness of the conductor sheet

If the current is held constant, and the other constants are disregarded, the Hall voltage will be directly proportional to the magnetic field strength.

The foremost advantages of using the Hall Effect to transmit data across a pipe junction are the ability to transmit data signals across a threaded junction without making a physical contact, the low power requirements for such transmission, and the resulting increase in battery life.

This invention has several distinct advantages over the mudpulse transmission systems that are commercially available, and which represent the state of the art. Foremost is the fact that this invention can transmit data at two to three orders of magnitude faster than the mudpulse systems. This speed is accomplished without any interference with ordinary drilling operations. Moreover, the signal suffers no overall attenuation since it is regenerated in each tubular member.

The improved wellbore tool of the present invention consists of a wellbore tool adapted to couple with a tubular member, or a string of tubular members. The wellbore tool of the present invention is adapted to sense downhole conditions, such as wellbore conditions, formation conditions, and tool conditions, and transmit the sensed data from the wellbore tool to an adjacent, coupled tubular member, across the threaded junction between the wellbore tool and the adjacent tubular member. Thereafter, the data stream may be transmitted up the drill string to a desired location, or utilized in the adjacent tubular member.

Figure 6:
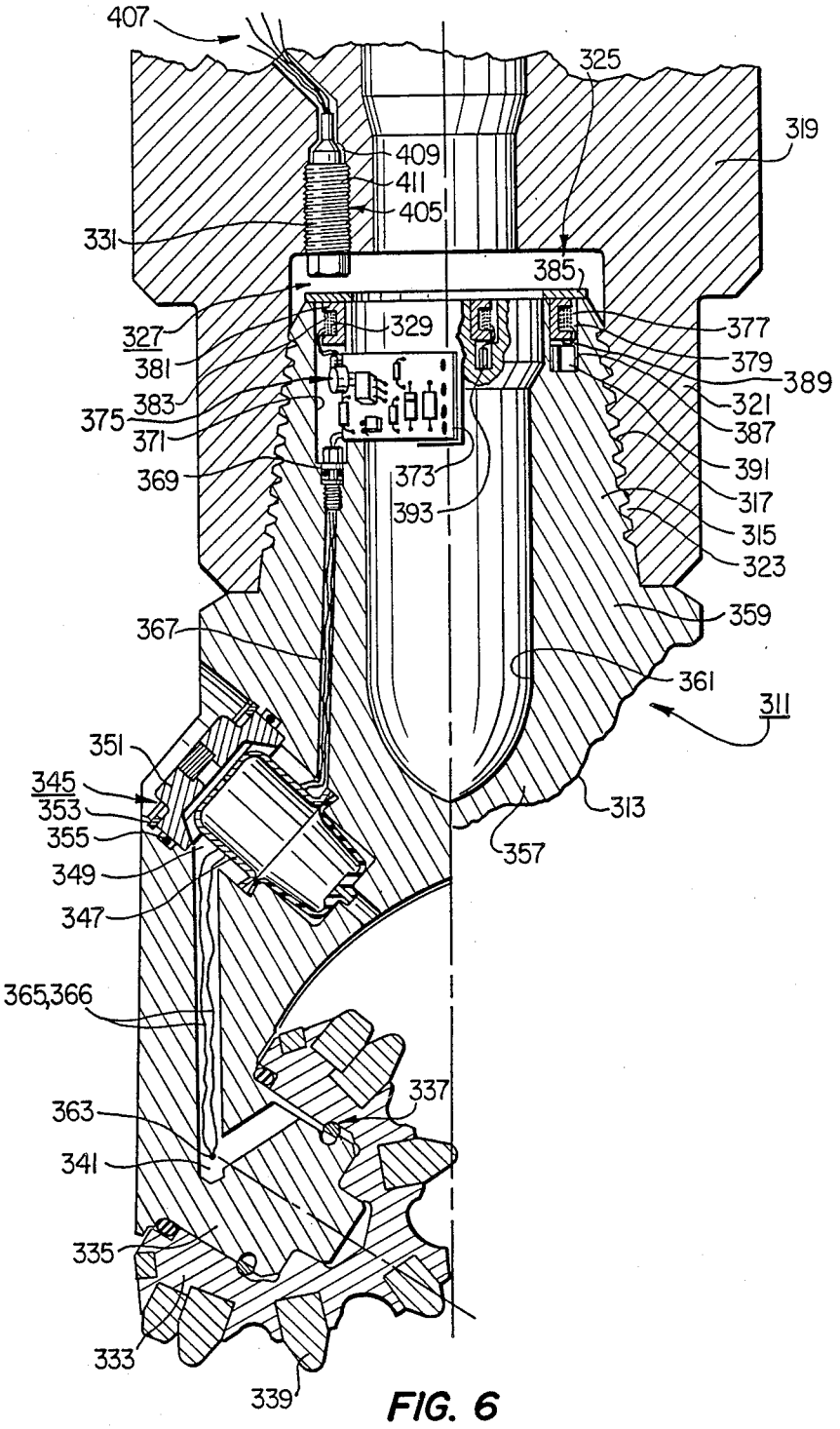
FIG. 6 is a fragmentary longitudinal section of a wellbore tool according to the present invention, coupled to a drill collar at a threaded junction.

Turning first to FIG. 6, wellbore tool 311 is shown in fragmentary longitudinal section. In the embodiment depicted in FIG. 6, wellbore tool 311 comprises a drill bit 313 having a pin end 315 with external threads 317 for coupling to tubular member 319 at internal threads 323 of box end 321. Tubular member 319 may be any tubular member adapted for connection in a drill string, including but not limited to drill collar, drill string subassemblies, or mud pulse data transmission subassemblies. When wellbore tool 311 is coupled to tubular member 319, the uppermost portion of pin end 315 of wellbore tool 311 is separated from uppermost portion of box end 321 of tubular member 319 by a tiny junction 325. Often, junction 325 is filled with pipe dope which serves to lubricate internal and external threads 317, 323 to facilitate coupling and decoupling of wellbore tool 311 from the drill string.

Drill bit 313 is specially adapted for the transmission of data from pin end 315 to box end 321 of the adjacent tubular member 319, without requiring physical electrical contact at junction 325; rather, data is transmitted from drill bit 313 to tubular member 319 through Hall Effect coupling 327, which comprises a Hall Effect transmitter means 329 carried by the pin end of drill bit 313, and Hall Effect receiver means 331 which is carried by tubular member 319 at box end therein Hall Effect transmitter means 329 cooperates with Hall Effect receiver means 331 to transmit data across junction 325.

In the embodiment of FIG. 6, drill bit 313 is specially adapted to gather, process, and transmit data signals to the adjacent connected tubular member 319. As is known to one of average skill in the art, the ordinary drill bit 313 consists of a plurality of cutters like cutter 333 which are rotatably carried by bearing shafts like bearing shaft 335. In FIG. 6, only one cutter 333 and one bearing shaft 335 are depicted, to simplify the drawings, and facilitate exposition. Cutter 333 is coupled to bearing shaft 335 by retaining means 337, which usually consists of a snap ring. A plurality of earth disintegrating teeth 339 are disposed about cutter 335, and serve to work against the formation as the drill string is rotated. Lubrication passage 341 extends through bearing shaft 335, and serves to provide lubricant to cutter 333 to reduce the frictional energy losses between cutter 333 and bearing shaft 335, and to enhance and prolong the operation of drill bit 313. Lubrication passage 341 extends downward from lubrication system 345. As is known by one of average skill in the industry, lubrication system 345 usually comprises a compensator 347 disposed in a compensator cavity and held in place by compensator cap 351, which is secured to drill bit 313 by snap ring 353, and sealed at O-ring 355.

Most drill bits have three cutters, each mounted on bearing shafts, and lubricated by lubrication systems via a lubrication passages. The bearing shafts are united at drill bit body 357. At its upper end, drill bit body 357 tapers to a shank 359, which has a central cavity 361. Drilling fluid is forced downward through central cavity 361, and forced through bit nozzles (not depicted) for aiding in the cutting process, and for washing cuttings from the bottom of the hole.

The wellbore tool 311 of the present invention is specially adapted for collecting, processing, and transmitting downhole data. In the embodiment depicted in FIG. 6, temperature sensor 363 is disposed in lubrication passage 341 of bearing shaft 335, serving to monitor the temperature of the lubricant therein. Under ordinary operating conditions, drill bit 313 is expected to have a temperature of approximately the ambient wellbore temperature plus about 100° Fahrenheit. Temperatures which greatly exceed this threshold may indicate an imminent bit failure caused by a variety of factors, including loss of lubricant from lubrication system 345, or bearing failure. Drill bit temperatures in the range of 500° Fahrenheit certainly indicate mechanical problems with the operation of the bit.

Signal wires 365, 366 are coupled to temperature sensor 363, and routed through lubrication passage 341, into compensator cavity 349, and around compensator 347. A wire passage 367 is provided in drill bit 313; it and extends upward from compensator cavity 349 through shank 359, and is slightly enlarged at pin end 315 where it communicates with junction 325. Feed through 369 is provided at the transition to the enlarged portion of wire passage 357 to prevent the flow of lubricant upward. Signal wires 365, 366 are disposed in wire passage 367, and coupled to feed through 369. The enlarged portion of wire passage 367 forms a circuit cavity 371 at pin end 315. Circuit cavity 371 is semi-circular in configuration, extends radially within pin end 315 for approximately 180°, and is adapted to accept flexible circuit board 373 which has a signal processing circuit 375 mounted thereon. In the preferred embodiment, temperature sensor 363 consists of a thermocouple; therefore, signal wires 365, 366 serve as both temperature sensor 363 and signal wires 365, 366.

A small, 360° radial cavity 377 is provided at pin end 315 directly above circuit cavity 371 which is adapted to accommodate a radial electromagnet, consisting of a non-metallic bobbin 381 with a plurality of windings 383. The metal of the wellbore tool 311 serves as the metal core for the electromagnet; alternately, a metal bobbin may be used instead of the non-metallic bobbin. Radial electromagnet 379 is secured within radial cavity 377, and protected from the wellbore environment by a Monel vapor barrier 385. Two tiny compartments are also provided in the pin end 315 of drill bit 313, namely battery compartment 387 and capacitor compartment 389. Battery compartment 387 and capacitor compartment 389 are accessible only through radial cavity 377, and are disposed beneath radial cavity 377 in regions of pin end 315 not occupied by circuit cavity 371. Battery 391 is light-interference fit into battery compartment 387. The ground end of battery 391 makes physical contact with shank 359 of drill bit 313 . Capacitor 393 is disposed in capacitor compartment 389, and is physically coupled to drill bit 313 at one terminal, through light-interference fit. Small electrical wires are routed through radial cavity 377 to electrically connect battery 391, capacitor 393, signal processing circuit 375, and radial electromagnet 379. Capacitor 393 is connected in parallel with battery 391 and serves as an energy storage capacitor; together, battery 391 and capacitor 393 provide power to signal processing circuit 375 as required. Signal processing circuit 375 receives data signals from temperature sensor 363, and processes those data signals for transmission across junction 325 by radial electromagnet 379.

Figure 7:
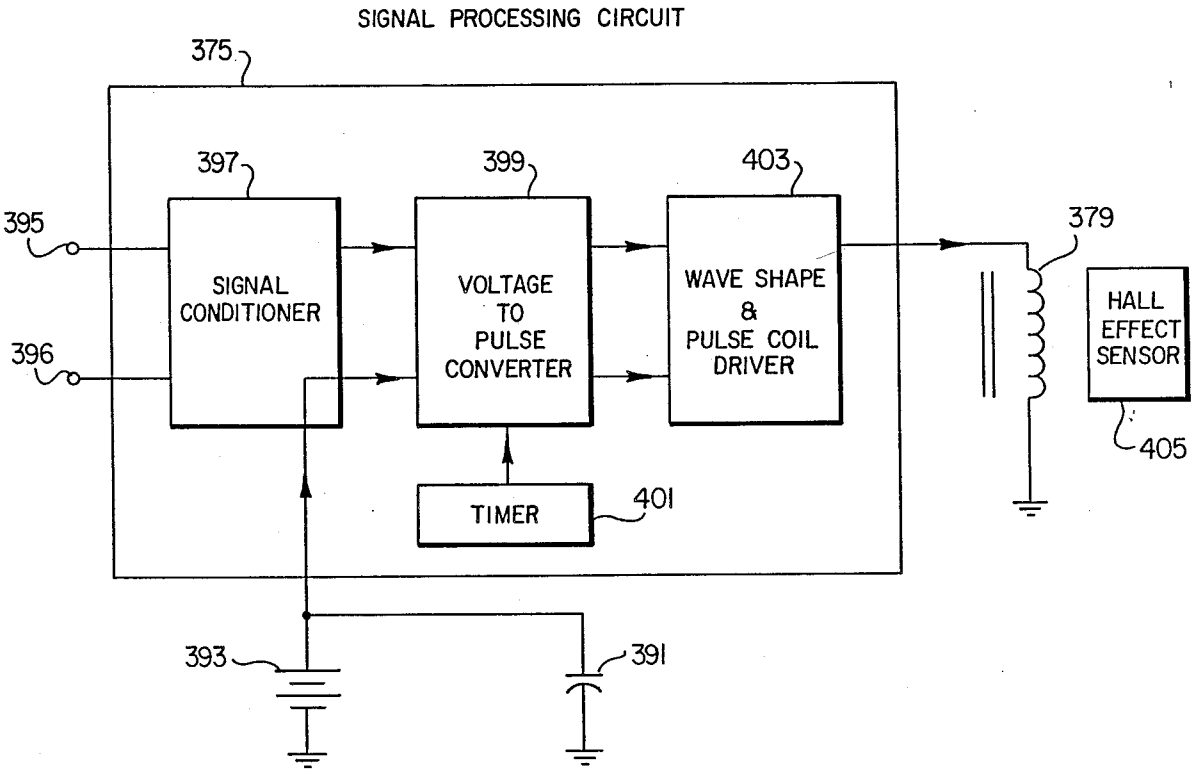
FIG. 7 is a block diagram of one preferred signal processing circuit of the present invention.

With reference now to FIG. 7, signal processing circuit 375 will now be described. A sensor signal is provided at input terminal 395, 396. First, the signal is routed through a signal conditioning circuit 397, which serves to amplify and linearize the signal received from the temperature sensor 363. For example, an Analog Device AD594 Thermocouple Amplifier may be employed to both amplify and linearize the data signal. Of course, at this stage, a voltage amplitude corresponds to the temperature sensed by temperature sensor 363. Since amplitude data is difficult to transmit, this voltage signal is preferably converted into a series of discreet pulses at voltage-to-pulse convertor 399. A variety of commercially available voltage-to-pulse convertors exist for converting amplitude data into a series of pulses. For example, an Analog Devices AD658 Voltage-to-Frequency Convertor may be employed, or a Burr Brown VFC100 Synchronized Voltage-to-Frequency Convertor may be employed. A timing circuit 401 may be provided to regulate the time interval between transmissions of sensor data. To conserve battery power, such readings may be selected to occur at periodic intervals. Next, the pulses produced by voltage-to-pulse convertor 399 are routed through a wave shaping and pulse coil driver circuit 403. At this stage, the pulses produced by voltage-to- -pulse convertor 399 are altered in amplitude, or width as required to match reception system in tubular member 319. As discussed above in connection with FIG. 5, the wave shaping may be accomplished by a mono-stable multi-vibrator. The pulse coil driver function may be accomplished by amplification sufficient to drive radial electromagnet 379. Of course, power is provided to the signal processing circuit 375 for all these functions by battery 391 and parallel connected capacitor 393.

With reference now to FIG. 6, magnetic pulses are transmitted across junction 325 by Hall Effect coupling 327. As discussed above, Hall Effect coupling 327 consists of Hall Effect transmitter means 329, which in the preferred embodiment is radial electromagnet 379, and Hall Effect receiver means which in the preferred embodiment consists of a Hall Effect sensor disposed at box end 321 of tubular member 319. Hall Effect sensor 405 is disposed in a threaded sensor holder 411 which is coupled to tubular member 319 at cavity 409 which is machined into box end 321 of tubular member 319. A plurality of conductors 407 connect the Hall Effect sensor 405 to a signal conditioning means similar or identical to that shown in FIG. 5. Alternately, conductors 407 may couple Hall Effect sensor 405 to a magnetic or electric memory means. Alternately, conductors 407 may connect Hall Effect sensor 405 to mud pulse equipment for transmission of data through the mud stream. Therefore, data may be transmitted up the wellbore either through the Hall Effect data transmission system of the present invention, or through existing prior art data transmission systems.

With reference now to FIG. 4, in operation, the wellbore tool of the present invention may comprise drill bit 213, or sensor package 217. Data pertaining to downhole Conditions, including formation conditions, tool conditions, and wellbore conditions may be sensed at drill bit 213 or sensor package 217, and transmitted at Hall Effect coupling 327 (of FIG. 6) to an adjacent tubular member. Data so acquired may be transmitted up the wellbore by the Hall Effect transmission system of the present invention as described in FIG. 4, or prior art systems such as mud pulsing technology.

Of course, alternate sensors may be employed in the wellbore tool 311 of the present invention. For example, pressure data, if desired, and may be sensed by known wellbore pressure sensors. Additionally, it may be desirable to measure the presence of moisture within the drill bit 313 cavities. A means for sensing moisture within such cavities is disclosed in U.S. Pat. No. 4,346,591 entitled "Sensing Impending Sealed Bearing and Gauge Failure," issued to Robert F. Evans, on Aug. 31, 1982. If information pertaining to wellbore and formation conditions is desired, a variety of conventional sensors may be employed in the wellbore tool 311 of the present invention. Also, a plurality of sensors may be provided simultaneously in the wellbore tool to provide an array of data signals; the only additional requirement is that a multiplexing circuit be provided between signal conditioner 397 and voltage-to-pulse convertor 399. If multiple sensors are provided, an Analog Devices Model No. ADG506 CMOS 8/16 Channel Analog Multiplexer may be utilized; alternately, or a Burr Brown MPC801 CMOS Analog Multiplexer may be employed to multiplex the signals.

The improved wellbore tool of the present invention has a variety of advantages over existing wellbore tools. One principle advantage is that the wellbore tool of the present invention operates as "smart" tools which is capable of gathering information pertaining to downhole conditions through the operation of sensors provided within the tool. Such information may then be transmitted across the threaded coupling between the wellbore tool and the drill string, and thereafter transmitted to the earth's surface through one or more data transmission systems, including the Hall Effect coupling data transmission system disclosed herein.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

I claim:

1. An improved wellbore tool for coupling to a drill string at a threaded junction and adapted for use in a wellbore during drilling, comprising:

a sensor disposed in said wellbore tool for sensing a downhole condition and producing a data signal corresponding thereto; and a Hall Effect coupling transmitter means, carried by the wellbore tool and coupled to said sensor, for generating a magnetic field in response to said data signal provided by said sensor and transmitting data from said Hall Effect coupling transmitter means to a Hall Effect coupling receiver carried by said drill string and disposed across said threaded junction from said wellbore tool, wherein data is transmitted across said threaded junction without requiring an electrical connection at said threaded junction.

2. An improved earth boring drill bit for coupling to a drill string at a threaded junction and adapted for use in a wellbore during drilling, comprising:

a sensor disposed in said drill bit for sensing a downhole condition and producing a data signal corresponding thereto; and a Hall Effect coupling transmitter means, carried by the drill bit and coupled to said sensor, for generating a magnetic field in response to said data signal provided by said sensor to transmit data from said Hall Effect coupling transmitter means to a Hall Effect coupling receiver carried by said drill string and disposed across said threaded junction from said drill bit, wherein data is transmitted across said threaded junction without requiring an electrical connection at said threaded junction.

3. An improved earth boring drill bit for coupling to a drill string at a threaded junction and adapted for use in a wellbore during drilling, comprising:

a sensor disposed in said earth boring drill bit for sensing a downhole condition and producing a data signal corresponding thereto;

a Hall Effect coupling transmitter means, coupled to said sensor, for generating a magnetic field in response to said data signal provided by said sensor and transmitting data from said Hall Effect coupling transmitter means to a Hall Effect coupling receiver carried by said drill string and disposed across said threaded junction from said wellbore tool, wherein data is transmitted across said threaded junction without requiring an electrical connection at said threaded junction; and a signal conditioning means disposed in said wellbore tool, and coupled between said sensor and said Hall Effect coupling transmitter means, for shaping said data signal received from said sensor prior to transmission by said Hall Effect coupling transmitter means.

4. An improved means for transmitting signals in a wellbore between a wellbore tool and an adjacent tubular member coupled together at a threaded junction, comprising:

a sensor disposed in said wellbore tool for sensing a wellbore condition and producing a data signal corresponding thereto;

a Hall Effect coupling transmitter means, coupled to said sensor, for generating a magnetic field in response to said data signal provided by said sensor and transmitting data across said threaded junction from said wellbore tool;

a Hall Effect coupling receiver means, carried by said tubular member, for sensing said magnetic field produced by said Hall Effect coupling transmitter means, wherein data is transmitted across said threaded junction without requiring an electrical connection at said threaded junction; and means for providing power to said Hall Effect coupling transmitter means, and said Hall Effect coupling receiver means.

5. An improved means for transmitting signals in a wellbore between a wellbore tool and an adjacent tubular member coupled together at a threaded junction, comprising:

a sensor disposed in said wellbore tool for sensing a wellbore condition and producing a data signal corresponding thereto;

a Hall Effect coupling transmitter means, coupled to said sensor, for generating a magnetic field in response to said data signal provided by said sensor and transmitting data across said threaded junction from said wellbore tool;

a Hall Effect coupling receiver means, carried by said tubular member, for sensing said magnetic field produced by said Hall Effect coupling transmitter means, wherein data is transmitted across said threaded junction without requiring an electrical connection at said threaded junction; and a signal conditioning means disposed in said wellbore tool, and coupled between said sensor and said Hall Effect coupling transmitter means, for shaping said data signal received from said sensor prior to transmission by said Hall Effect coupling transmitter means.

6. An improved earth boring drill bit for coupling to a drill string at a threaded junction and adapted for use in a wellbore during drilling, comprising:

a sensor disposed in said wellbore tool for sensing a downhole condition and producing a data signal corresponding thereto;

a Hall Effect coupling transmitter means, coupled to said sensor, for generating a magnetic field in response to said data signal provided by said sensor and transmitting data from said Hall Effect coupling transmitter means to a Hall Effect coupling receiver carried by said drill string and disposed across said threaded junction from said wellbore tool, wherein data is transmitted across said threaded junction without requiring an electrical connection at said threaded junction;

means for providing power to said Hall Effect coupling transmitter means; and means for transmitting said data signal to a selected location in said drill string.

7. An improved wellbore tool for coupling to a drill string at a threaded junction and adapted for use in a wellbore during drilling, comprising:

a sensor disposed in said wellbore tool for sensing a downhole condition and producing a data signal corresponding thereto;

a Hall Effect coupling transmitter means, coupled to said sensor, for generating a magnetic field in response to said data signal provided by said sensor and transmitting data from said Hall Effect coupling transmitter means to a Hall Effect coupling receiver carried by said drill string and disposed across said threaded junction from said wellbore tool, wherein data is transmitted across said threaded junction without requiring an electrical connection at said threaded junction;

a power supply disposed in said wellbore tool for providing power to said Hall Effect coupling transmitter means, and said signal conditioning means;

a signal conditioning means disposed in said wellbore tool, and coupled between said sensor and said Hall Effect coupling transmitter means, for shaping said data signal received from said sensor prior to transmission by said Hall Effect coupling transmitter means; and means for transmitting said data signal to a selected location in said drill string.

8. An improved means for transmitting data signals in a drill string having a wellbore tool coupled to a tubular member at a threaded junction, comprising:

a sensor disposed in said wellbore tool for sensing a wellbore condition and producing a data signal corresponding thereto;

a Hall Effect coupling transmitter means, coupled to said sensor, for generating a magnetic field in response to said data signal provided by said sensor and transmitting data across said threaded junction from said wellbore tool;

a Hall Effect coupling receiver means, carried by said tubular member, for sensing said magnetic field produced by said Hall Effect coupling transmitter means, wherein data is transmitted across said threaded junction without requiring an electrical connection at said threaded junction; and means for transmitting said data signal to a selected location in said drill string.

9. An improved means for transmitting data signals in a drill string having a wellbore tool coupled to a tubular member at a threaded junction, comprising:

a sensor disposed in said wellbore tool for sensing a wellbore condition and producing a data signal corresponding thereto;

a Hall Effect coupling transmitter means, coupled to said sensor, for generating a magnetic field in response to said data signal provided by said sensor and transmitting data across said threaded junction from said wellbore tool;

a Hall Effect coupling receiver means, carried by said tubular member, for sensing said magnetic field produced by said Hall Effect coupling transmitter means, wherein data is transmitted across said threaded junction without requiring an electrical connection at said threaded junction;

a signal conditioning means disposed in said wellbore tool, and coupled between said sensor and said Hall Effect coupling transmitter means, for shaping said data signal received from said sensor prior to transmission by said Hall Effect coupling transmitter means; and means for transmitting said data signal to a selected location in said drill string.

10. An improved means for transmitting data signals in a drill string having a wellbore tool coupled to a tubular member at a threaded junction, comprising:

a wellbore tool having a sensor disposed therein for sensing a downhole condition and producing a data signal corresponding thereto;

a tubular member with threaded ends adapted for connection in a drill string, having one end adapted for transmitting data signals and the other end adapted for receiving data signals, coupled to said wellbore tool at said receiving end;

a Hall Effect coupling receiver means for receiving magnetic signals, carried by the receiving end of said tubular member; and a Hall Effect coupling transmitter means, coupled to said sensor, for generating a magnetic field in response to said data signal provided by said sensor and transmitting data from said Hall Effect coupling transmitter means to said Hall Effect coupling receiver means carried by said tubular member and disposed across said threaded junction from said wellbore tool, wherein data is transmitted across said threaded junction without requiring an electrical connection at said threaded junction.

* * * * *